US011105083B2

(12) United States Patent
Dirani

(10) Patent No.: US 11,105,083 B2
(45) Date of Patent: Aug. 31, 2021

(54) PLUMBING FIXTURE

(71) Applicant: Houssam Dirani, Bexley (AU)

(72) Inventor: Houssam Dirani, Bexley (AU)

( * ) Notice: Subject to any disclaimer, the term of this patent is extended or adjusted under 35 U.S.C. 154(b) by 0 days.

(21) Appl. No.: 16/476,311

(22) PCT Filed: Jan. 9, 2018

(86) PCT No.: PCT/AU2018/050008
§ 371 (c)(1),
(2) Date: Jul. 8, 2019

(87) PCT Pub. No.: WO2018/126300
PCT Pub. Date: Jul. 12, 2018

(65) Prior Publication Data

US 2019/0368185 A1 Dec. 5, 2019

(30) Foreign Application Priority Data

Jan. 9, 2017 (AU) ..... AU2017900032

(51) Int. Cl.
*E03F 5/04* (2006.01)

(52) U.S. Cl.
CPC ..... *E03F 5/0411* (2013.01)

(58) Field of Classification Search
CPC ..... E03F 5/0411
USPC ..... 4/295
See application file for complete search history.

(56) References Cited

U.S. PATENT DOCUMENTS

| | | | | |
|---|---|---|---|---|
| 1,786,558 | A | 12/1930 | Boosey | |
| 2,743,786 | A * | 5/1956 | Boosey | E03F 5/0409 210/165 |
| 4,562,602 | A * | 1/1986 | Cuschera | E03C 1/22 285/136.1 |
| 4,698,513 | A | 9/1987 | Kiziah | |
| 5,022,430 | A | 6/1991 | Degooyer | |
| 9,139,989 | B2 * | 9/2015 | Meyers | E03C 1/26 |
| 2001/0052699 | A1 | 12/2001 | Guest | |
| 2010/0043136 | A1 * | 2/2010 | Michael | A47K 3/40 4/613 |
| 2010/0123307 | A1 * | 5/2010 | Coronado | E03D 11/16 285/56 |
| 2016/0002906 | A1 | 1/2016 | Adams | |

* cited by examiner

*Primary Examiner* — Jeremy Carroll
(74) *Attorney, Agent, or Firm* — Thomas M. Joseph, Esq

(57) ABSTRACT

In a first aspect there is disclosed a plumbing fixture (10) to be installed in a waste plumbing installation. The plumbing fixture (10) includes a fixture body (12) having (i) an inlet conduit (14) defining an inlet opening (24), and (ii) an outlet conduit (16) defining an outlet opening (26). The inlet and outlet conduits (14, 16) define a flow passage (18) to provide fluid communication between the inlet opening (24) and the outlet opening (26). The outlet conduit (14) is operatively placed in fluid communication with the waste plumbing installation. The plumbing fixture (10) further includes a peripheral flange (20) which (a) extends outwardly from an outer surface of the fixture body (12), and (b) is located at a position between the inlet opening (24) and the outlet opening (26) of the fixture body (12). The peripheral flange (20) is operatively adapted to span an opening formed between the plumbing installation and a surface surrounding the plumbing installation.

20 Claims, 10 Drawing Sheets

PLUMBING FIXTURE

CROSS REFERENCE TO RELATED APPLICATIONS

The present application is a U.S. national stage application of PCT International Application No. PCT/AU2018/050008, filed Jan. 9, 2018, and published as PCT Publication WO/2018/126300 on Jul. 12, 2018, which claims priority to Australian Application No. AU 2017900032, filed on Jan. 9, 2017. The disclosures of all the foregoing applications are hereby incorporated by reference in their entirety into the present application.

FIELD

The present invention relates to a plumbing fixture, in particular but not exclusively, a plumbing fixture for use in a floor waste plumbing installation.

BACKGROUND

A floor waste is a plumbing installation provided inside a floor of a building which serves to drain standing water proximate the waste. For example, a shower is provided with a floor waste to drain spent water from the shower floor. A typical floor waste defines a water conduit through which waste water can be fed to waste piping of the building. The floor surface surrounding a floor waste is typically sloped to ensure standing water flows towards the waste. To prevent injury to a person stepping across the inlet of the floor waste or the possible loss of valuables falling down drain piping, a floor waste generally is fitted with a strainer sized to cover the inlet of the waste. A conventional strainer comprises a perforated sieve to filter out solid debris from floor waste liquid passing therethrough.

To install a floor waste, an opening in a floor surface is required. An appropriately sized drainage puddle flange is located in the opening, fitted to a drainage riser pipe and fixed on the floor surface with appropriate bedding material. With the drainage riser pipe extending through the opening, a gap will typically exist between the riser pipe and surrounding floor surface. The purpose of the puddle flange is to cover that gap to deter leakage of waste water into the gap. If the riser pipe does not extend far enough through the floor or extends too far through the floor various difficulties may be encountered to install the puddle flange or to cover the gap between the riser pipe and surrounding floor surface.

To prevent mortar or other building material clogging drainage pipework, tradesmen will during construction of a floor waste typically block the opening of the drainage puddle flange with a rag or other suitable object. A waterproof membrane can now be applied to the floor surface whereafter a screed is built on top of the drainage flange to support the floor waste to the required finished floor level. A screed is hereafter laid across the floor and trowelled to the correct level and height allowing for the thickness of, for example, an overlying tile layer. Finally, the strainer is installed in position.

Tradesmen who have been required to repair damage occasioned by burst water pipes in a tiled area will at times have noticed that spilled water under the tiles had accumulated due to no suitable drainage being available. Much damage could have been avoided had the appropriate drainage been available.

Another problem often encountered in waste plumbing installations is that inexperienced or careless tradesmen omit to block the inlet of the drainage flange with the result that building debris can fall into the waste piping and accumulate in the drain trap. Over the course of time solid matter passing through the strainer, for example hair, will cause blockages in the waste piping. Once an excess amount of matter has accumulated blockages will occur which could have significant cost implications for the property owner in having a blockage removed.

OBJECT

It is an object of the present invention substantially to overcome or at least ameliorate one or more of the above problems or to provide a useful alternative.

SUMMARY

In a first aspect there is disclosed herein a plumbing fixture to be installed in a waste plumbing installation, the plumbing fixture comprising:

a fixture body having (i) an inlet conduit defining an inlet opening, and (ii) an outlet conduit defining an outlet opening, the inlet and outlet conduits defining a flow passage to provide fluid communication between the inlet opening and the outlet opening, the outlet conduit operatively placed in fluid communication with the waste plumbing installation; and a peripheral flange which (a) extends outwardly from an outer surface of the fixture body and (b) is located at a position between the inlet opening and the outlet opening of the fixture body, the peripheral flange operatively adapted to span an opening formed between the plumbing installation and a surface surrounding the plumbing installation.

Preferably the plumbing fixture includes at least one drainage opening which extends through at least the inlet conduit or the outlet conduit to allow liquid to enter the flow passage through the at least one drainage opening.

Preferably the drainage opening extends through the peripheral flange.

Preferably a barrier is attached for the fixture body and is positioned to cover the at least one drainage opening.

Preferably the inlet opening is operatively adapted to permit waste liquid to enter the flow passage.

Preferably the outlet opening is operatively adapted to allow waste liquid to exit the flow passage.

Preferably the fixture body defines a barrier recess operatively adapted to hold a portion of the barrier.

Preferably the barrier recess is formed in an outer surface of the inlet conduit.

Preferably the barrier is releasably attached to the fixture body to enable removal thereof to expose the at least one drainage opening.

Preferably the at least one drainage opening is a first drainage opening and the flange includes a plurality of drainage openings.

Preferably the barrier comprises foam.

Preferably the foam is an open cell foam.

Preferably the inlet opening is closed with a removable cap.

Preferably inlet opening has an inlet diameter and the outlet opening has an outlet diameter, wherein the dimensions of the inlet diameter differ from the dimensions of the outlet diameter.

Preferably the dimensions of the inlet diameter are larger than the dimensions of the outlet diameter.

Preferably the inlet conduit includes an inlet conduit wall, the inlet conduit wall tapering outwardly in a direction extending from the peripheral flange to the inlet opening.

Preferably the outlet conduit includes an outlet conduit wall, the outlet conduit wall tapering outwardly inwardly in a direction extending from the peripheral flange to the outlet opening.

In another aspect there is disclosed herein a waste plumbing installation incorporating in plumbing fixture in accordance with the first aspect.

BRIEF DESCRIPTION OF THE DRAWINGS

Preferred embodiments of the invention will be described hereinafter, by way of examples only, with reference to the accompanying drawings wherein.

DESCRIPTION OF PREFERRED EMBODIMENTS

Figure 1:
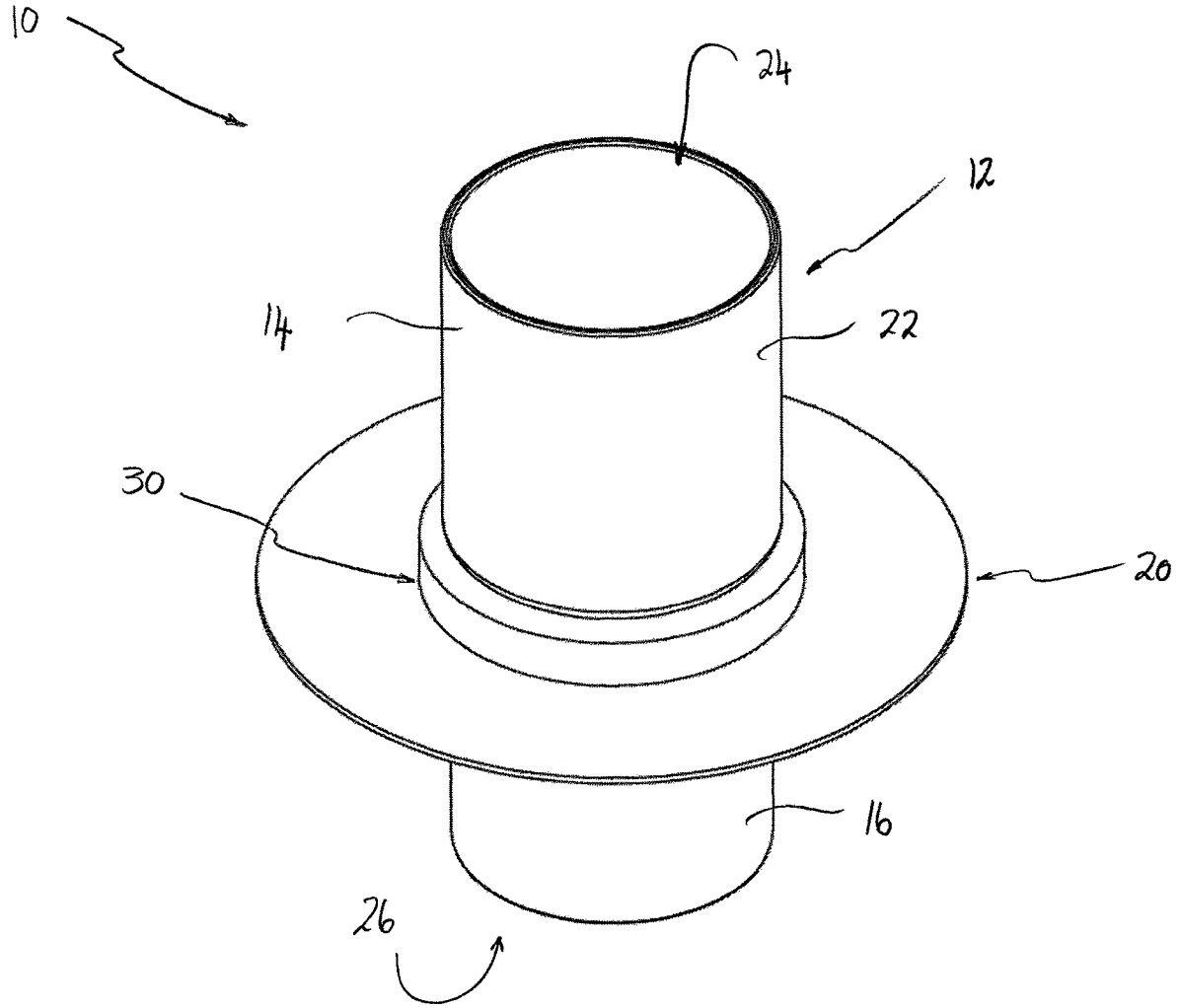
FIG. 1 is a schematic perspective view of a first embodiment plumbing fixture.
Figure 2:
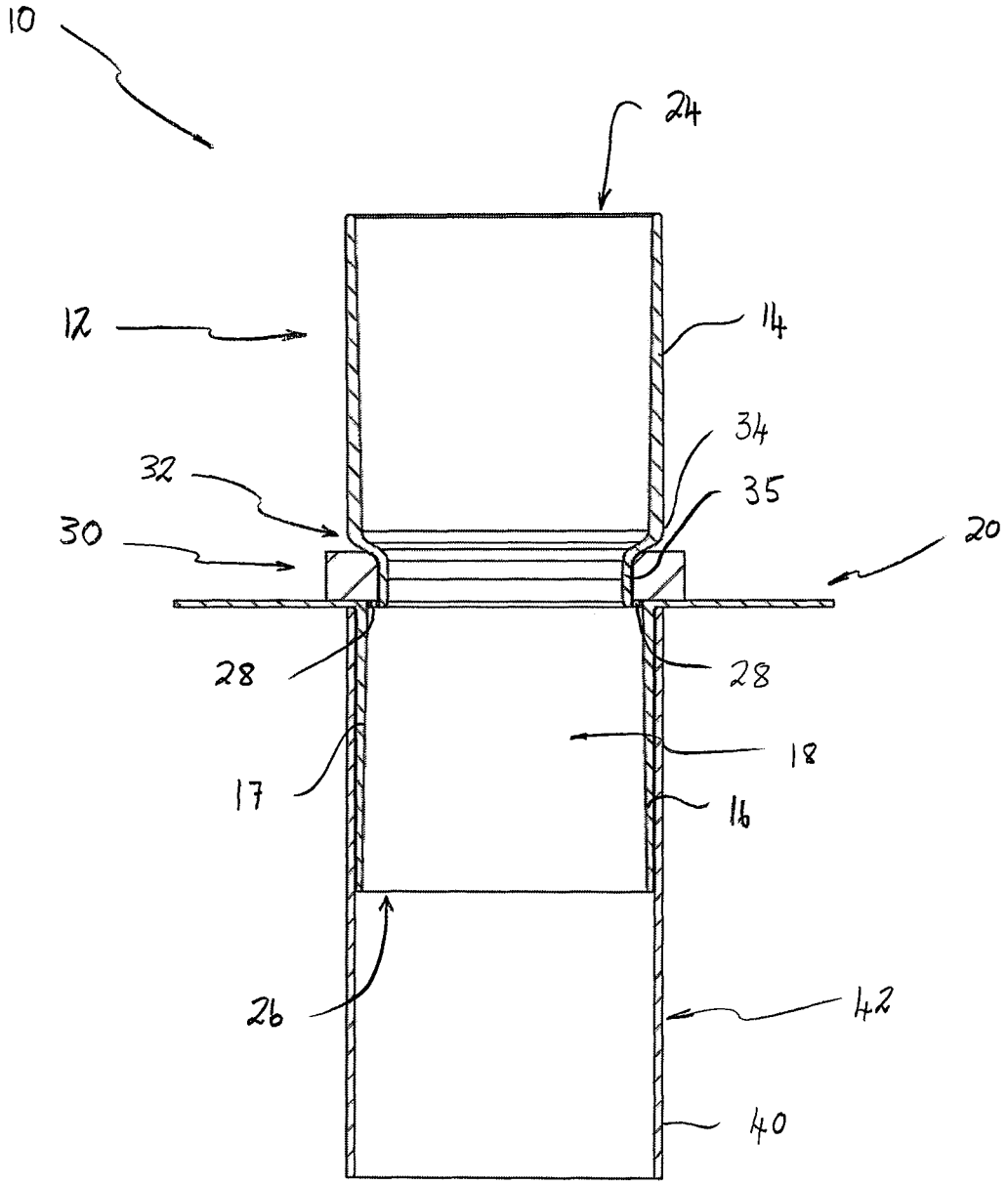
FIG. 2 is a schematic cross-sectional view of the plumbing fixture of FIG. 1 attached to piping of a waste plumbing installation.
Figure 3:
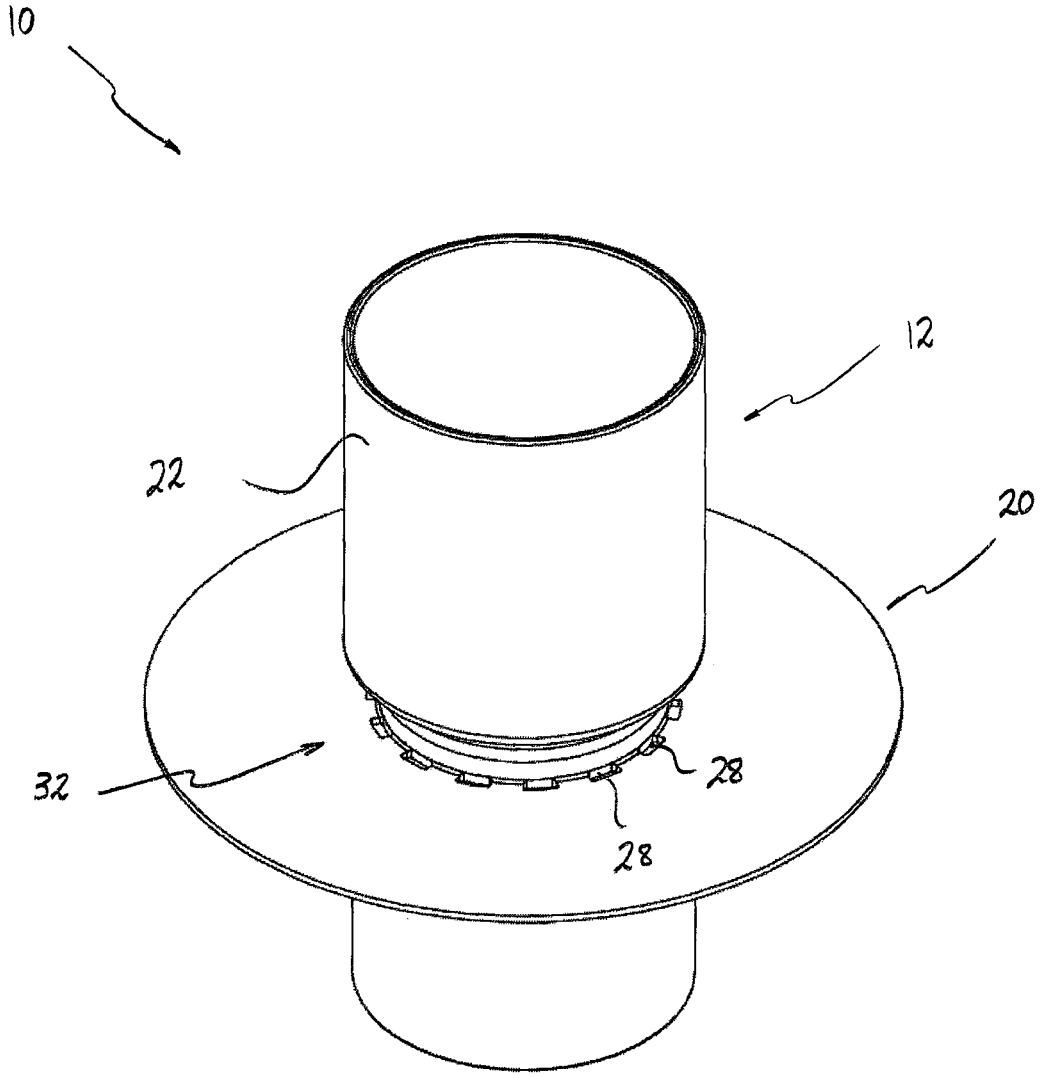
FIG. 3 is a schematic perspective view of the plumbing fixture of FIG. 1 wherein a barrier has been removed to expose a plurality of drainage openings.

FIGS. 1 and 2 show an embodiment plumbing fixture, generally indicated with the reference numeral 10. The plumbing fixture 10 is adapted for installation in a waste plumbing installation of a building as discussed below.

The plumbing fixture 10 comprises a fixture body 12 shaped as shown. The fixture body 12 has a tubular inlet conduit 14 and a tubular outlet conduit 16. The inlet and outlet conduits 14, 16 are in fluid communication. The inlet and outlet conduits 14, 16 define a flow passage 18, shown in FIG. 2, which in use will serve to drain floor waste from a floor surface to a riser pipe 40 of a waste plumbing installation 42. In this embodiment the plumbing fixture 10 is adapted to be received by a 100 mm diameter riser pipe. It will of course be appreciated that the outlet conduit 16 could be sized to be received by a range of riser pipe sizes, for example 40 mm or 50 mm diameter riser pipes.

The fixture body 12 further includes a peripheral flange 20 which extends radially outwardly from an outer surface 22 of the fixture body 12. The peripheral flange 20 is operatively adapted to secure the fixture body 12 in position proximate the waste plumbing installation 42. Both the inlet conduit 12 and the outlet conduit 14 extend outwardly from the peripheral flange 20. When fixed in position the outlet conduit 16 will be placed in fluid communication with the waste plumbing installation 42 so that waste fluid, for example floor waste water, received by the plumbing fixture 10 can be fed to the waste plumbing installation 42. In use the flange 20 will serve to span across a non-illustrated gap/opening between a floor surface in which the fixture body 12 is secured and an outer surface of the riser pipe 40. By having the flange 20 cover the gap/opening in the floor surface the unwanted ingress of water into the gap/opening is deterred in the same manner as if a conventional puddle flange were installed.

The inlet conduit 14 defines an inlet opening 24, having an inlet diameter (the inner diameter of the inlet conduit 14), operatively adapted to permit waste fluid to enter the flow passage 18. The outlet conduit 16, in turn, defines an outlet opening 26, having an outlet diameter (the inner diameter of the outlet conduit 16), operatively adapted to permit floor waste to exit the flow passage 18. The peripheral flange 20 is attached to the fixture body 12 at a position intermediate the inlet opening 24 and the outlet opening 26. As shown in FIG. 2, the thickness of the wall 15 of the inlet conduit 14 reduces in a direction extending from the peripheral flange 20 towards the inlet opening 24 and the inlet conduit wall 15 accordingly tapers outwardly (flares) towards the inlet opening 24. Similarly, the thickness of the wall 17 of the outlet conduit 16 reduces in a direction extending from the peripheral flange 20 towards outlet opening 26 and the outlet conduit wall 17 accordingly tapers outwardly (flares) towards the outlet opening 26. The purpose of this reduction in wall thickness will become clear from the description below.

The fixture body 12 includes a plurality of drainage openings 28 extending through the peripheral flange 20 and the inlet or outlet conduits 14, 16 of the fixture body 12. The drainage openings 28 are in fluid communication with the flow passage 18 and are configured to permit liquid to enter the flow passage 18 through the drainage openings 28.

The plumbing fixture 10 further includes a barrier 30 attached to the fixture body 12. The barrier 30 is configured and positioned to cover the drainage openings 28. The embodiment barrier 30 is produced from a water permeable material, in this instance an open cell foam, such that even when the barrier 30 closes the drainage openings 28 against the ingress of building materials, waste water is still permitted to pass therethrough into the flow passage 18. The embodiment fixture body 12 defines a barrier recess 32 operatively adapted to receive and hold a portion of the barrier 30. The barrier recess 32 is formed in an outer surface 34 of the inlet conduit 14. At the position of the barrier recess 32, the inlet conduit 14 defines a narrowing throat 35 where the inlet conduit 14 mouths into the outlet conduit 16. It will be noted that the diameter of the throat 35 is smaller in dimension than the diameter of the inlet opening 24 and that the outlet throat is operatively located above the peripheral flange 20.

The barrier 30 is releasably attached to the fixture body 12 to enable removal thereof to expose the drainage openings 28. Such attachment is enabled through the use of a glue which displays relative low bonding characteristics so as to permit relative ease of removal.

Figure 4:
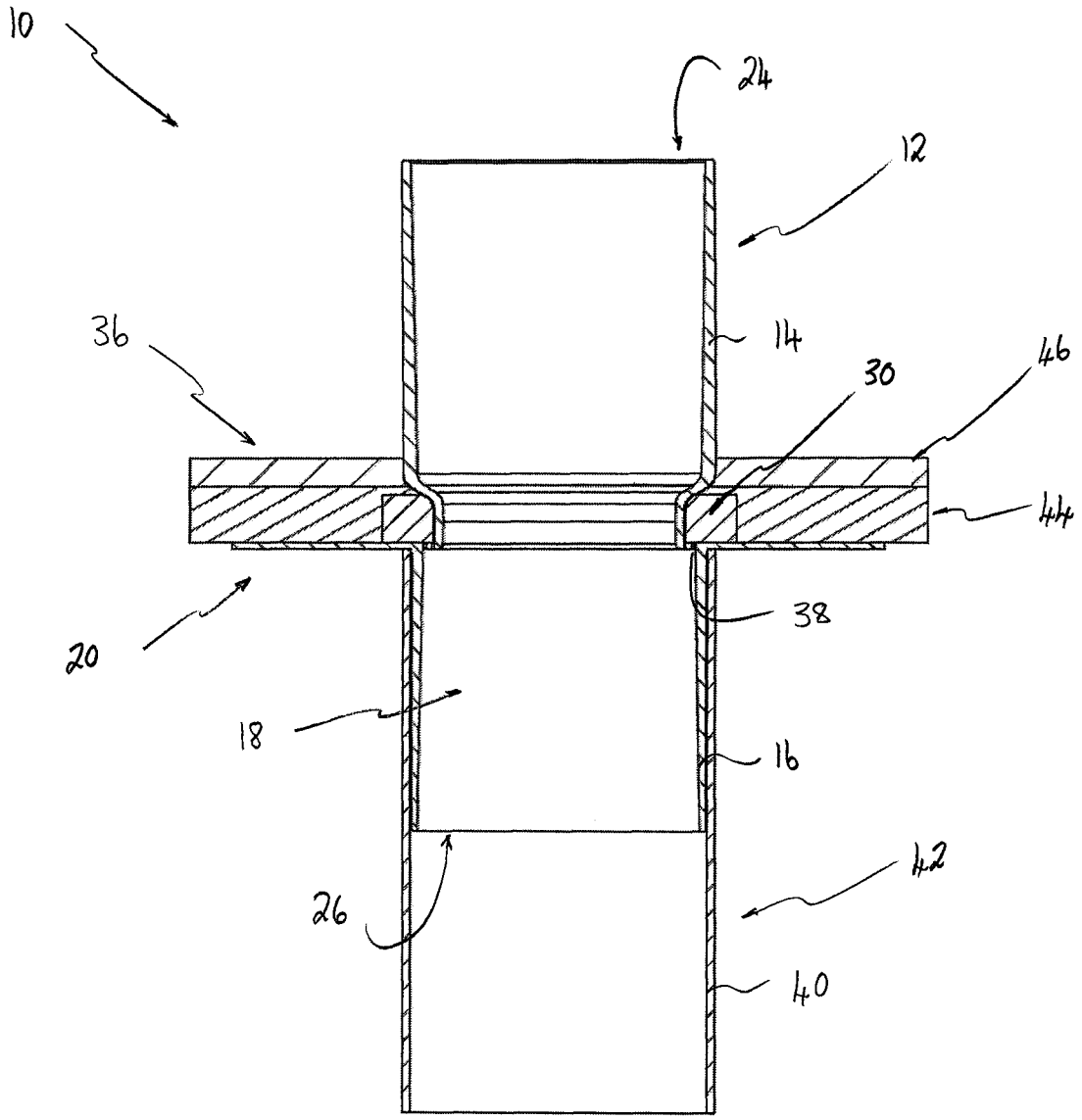
FIG. 4 is schematic cross-sectional view of the plumbing fixture of FIG. 1 installed in a floor surface and coupled to piping of a waste plumbing installation.

Referring also to FIG. 4, the plumbing fixture 10 is generally installed inside a floor surface 36 where removal of floor waste is required, for example water spilled on a tiled floor of a bathroom or inside a shower. The plumbing fixture 10 is located within an opening 38 inside the floor surface 36 and is coupled to the riser pipe 40 of the waste plumbing installation 42, the riser pipe 40 being cut flush with the floor surface. The outlet conduit 16 is slidably received within the riser pipe 40 as shown. To facilitate entry via a sliding movement the wall 17 of the outlet conduit 16 has the reduced wall thickness at the outlet opening 26 as discussed above. This will enable an amount of flexing within the outlet conduit 16 to enable manipulation required for locating the outlet conduit 16 within the riser pipe 40.

To prevent mortar or other building material dropping down the plumbing fixture 10 into the waste plumbing installation, it is desirable to block off the inlet opening 24. In this embodiment the inlet conduit has an outer diameter of 100 mm and is dimensioned to receive a standard 100 mm pipe cap shown in FIGS. 5 and 6. With the plumbing fixture 10 located inside the opening 38 and coupled to the riser pipe 40, a bedding layer 44 can be applied directly on top of the peripheral flange 20. Once the bedding layer 44 is in place a tile layer 46 is laid on top thereof. The cap can now be removed and a cutting implement employed to remove the excess length of the inlet conduit 14 which protrudes above the tile layer 46. An inlet opening 24 can accordingly be provided which is flush with the tile layer 46. A suitable strainer, not-illustrated, can finally be fixed in a manner which covers the inlet opening 24.

The plumbing fixture 10 of FIG. 4 has been secured in position without the barrier 30 having been removed. Should a burst pipe cause water to accumulate in the bedding layer 44 underneath the tile layer 46, water can syphon through the bedding layer 44, across the barrier 30 through the drainage openings 28 and into the flow passage 18. Such water can be drained via the waste plumbing installation 42.

The barrier 30 will often be removed after installation of the plumbing fixture 10 as its primary purpose is to prevent building debris falling into the waste plumbing installation 42 during installation of the plumbing 10. In such instance removal of the barrier 30 will provide a gap between the plumbing fixture 10 and the bedding and tile layers 44, 46. Such gap will provide a space in which a strainer can be located. However, should a tradesmen neglect to remove the barrier 30, water will still be able to pass therethrough to be drained away.

Figure 5:
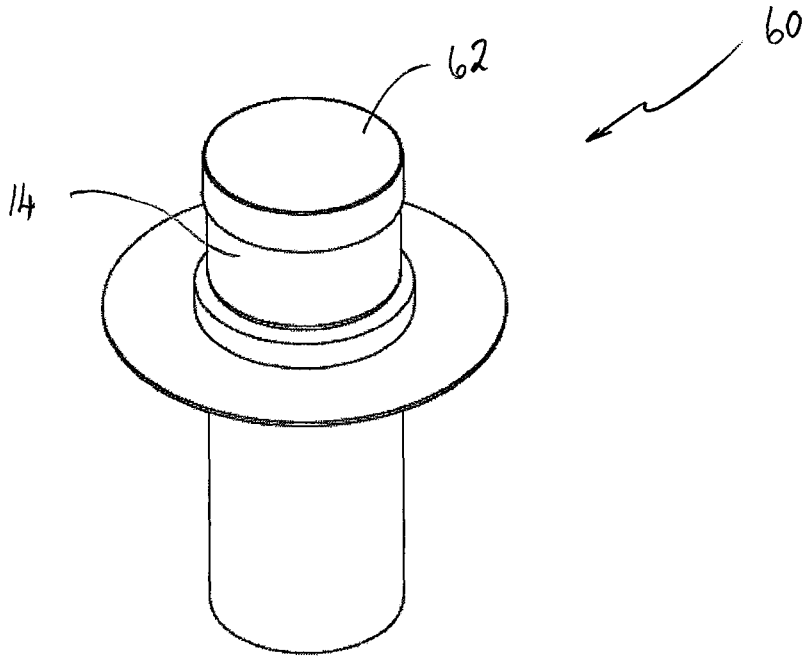
FIG. 5 is a schematic perspective view of a second embodiment plumbing fixture.
Figure 6:
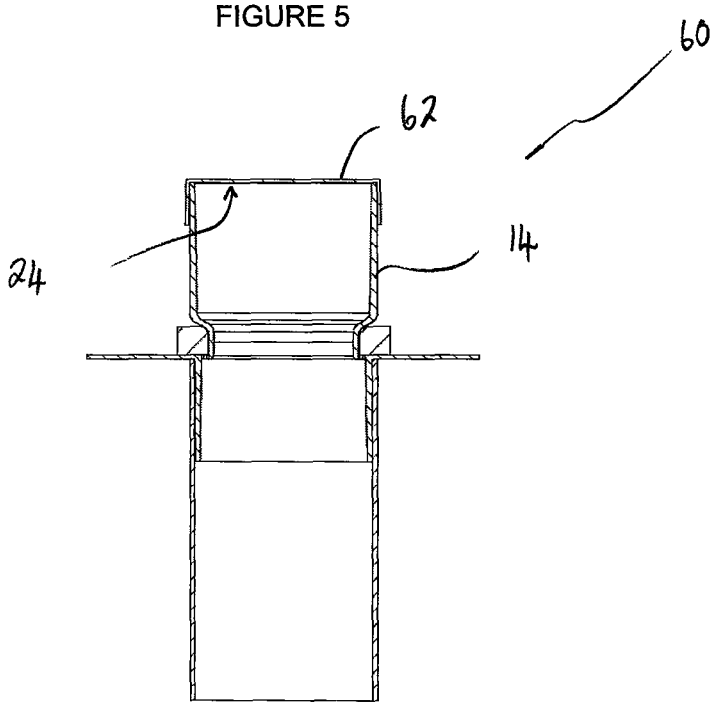
FIG. 6 is a schematic cross-sectional view of the plumbing fixture of FIG. 5.

As mentioned in the background of the specification one problem often encountered in the process of constructing waste plumbing installations is that inexperienced or careless tradesmen omit to block the inlet of the drainage flange with the result that building debris can fall into the waste piping and accumulate in the drain trap. To address this problem an embodiment plumbing fixture 60, shown in FIGS. 5 and 6, is provided with a conventional pipe cap 62. The cap 62 is fitted over the inlet opening 24 of the inlet conduit 14. As the inlet opening 24 is covered building material is prevented from entering the plumbing fixture 60. Once the installation process has been completed the cap 62 can simply be removed to expose the inlet opening 24.

Figure 7:
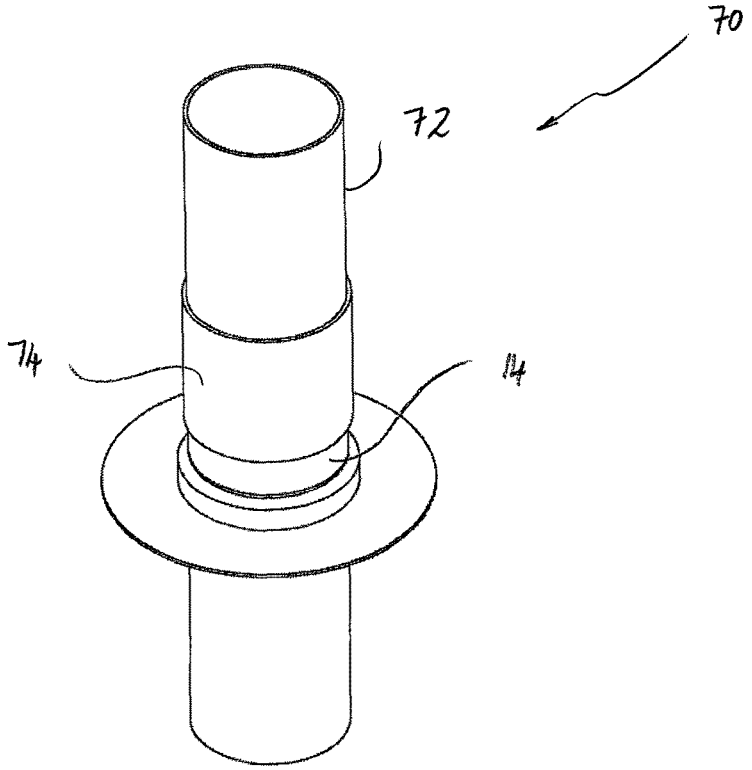
FIG. 7 is a schematic perspective view of a third embodiment plumbing fixture.
Figure 8:
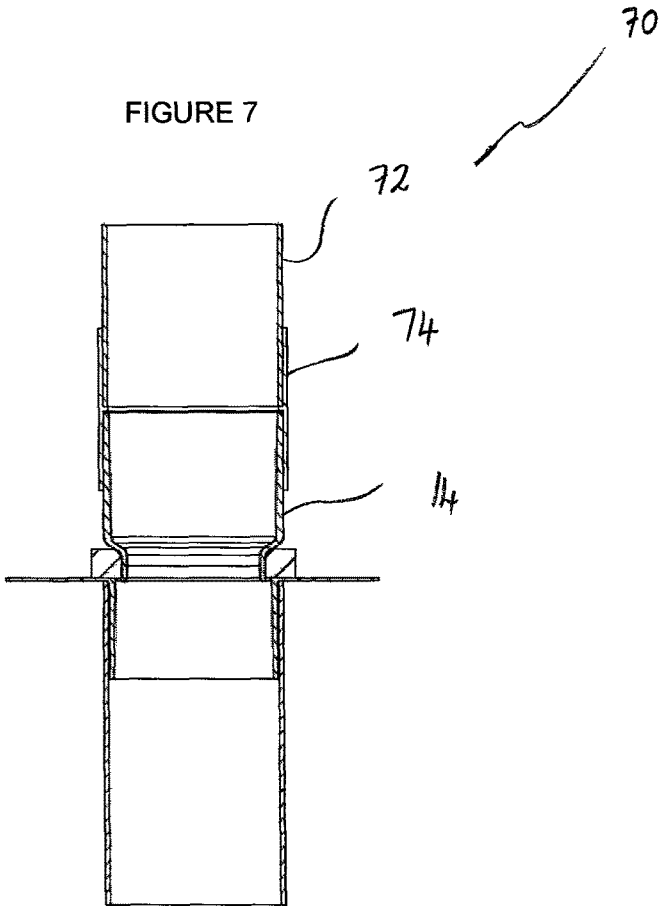
FIG. 8 is a schematic cross-sectional view of the plumbing fixture of FIG. 7.

FIGS. 7 and 8 show a third embodiment plumbing fixture 70 wherein the inlet conduit 14 is coupled to a down pipe 72 of a waste plumbing installation. In this instance the inlet conduit 14 is coupled to a straight coupler 74 which in turn is coupled to the waste plumbing installation 72. Although not shown, the inlet conduit 14 is adapted to be coupled to other couplers to be joined to different fittings, for example 45° or 90° angle fittings.

The inlet conduit 14, outlet conduit 16 and peripheral flange 20 of the embodiment plumbing fixture 10 is of unitary construction and is produced from a polymer. It will of course be appreciated that a range of materials could be employed for producing embodiment plumbing fixtures.

Figure 9:
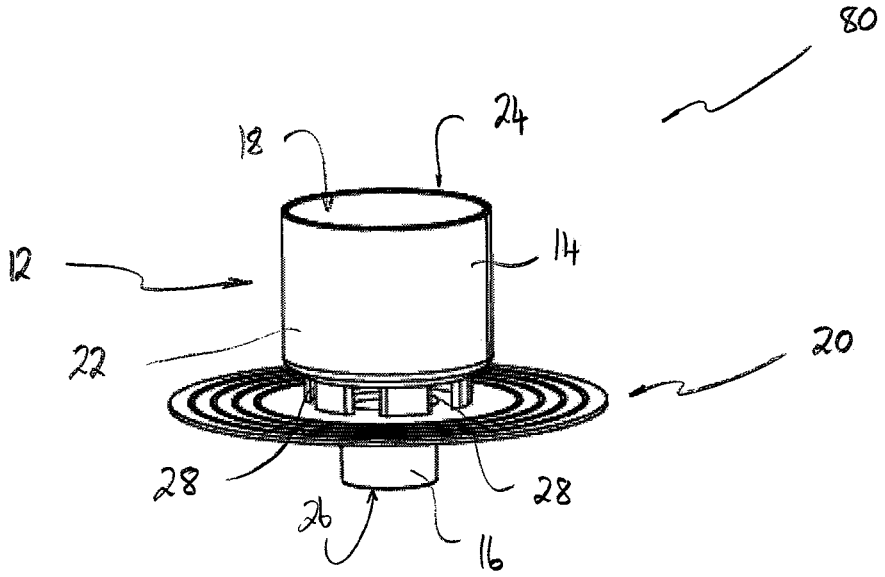
FIG. 9 is a schematic perspective view of a fourth embodiment plumbing fixture.
Figure 10:
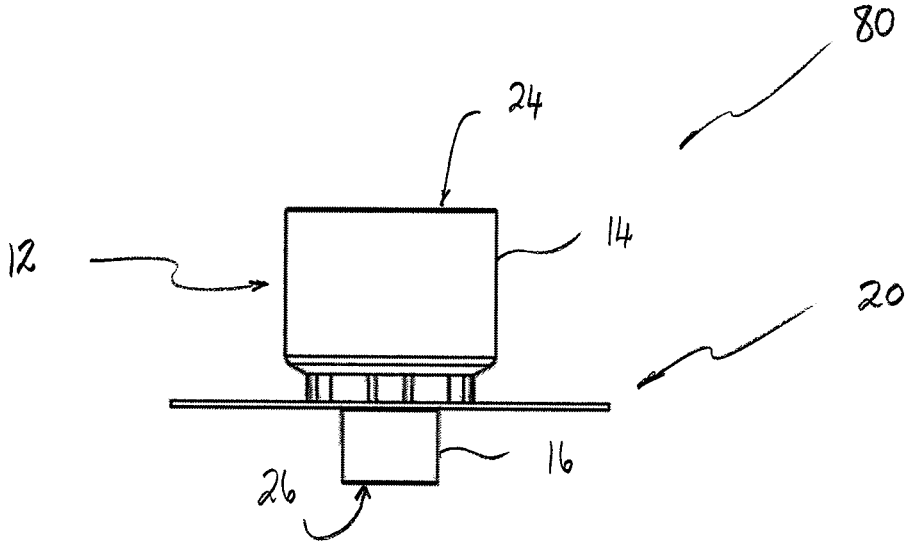
FIG. 10 is a schematic side view of the plumbing fixture of FIG. 9.

FIGS. 9 and 10 show a fourth embodiment plumbing fixture 80 for installation in a non-illustrated waste plumbing installation. The plumbing fixture 80 comprises a fixture body 12 having an inlet conduit 14 which defines an inlet opening 24 having an inlet diameter. The fixture body 12 includes an outlet conduit 16 which defines an outlet opening 26 with an outlet diameter, the outlet diameter being smaller in dimensions than the inlet diameter. The inlet and outlet conduits 14, 16 define a flow passage 18 to provide fluid communication between the inlet and outlet openings 24, 26. The plumbing fixture 80 further includes a peripheral flange 20 which extends outwardly from an outer surface 22 of the fixture body 12 and is located at a position between the inlet and outlet opening 24, 26. The peripheral flange 20 is sized and operatively adapted to span a non-illustrated opening formed between the plumbing installation and a surface surrounding the plumbing installation so as to operate as if a conventional puddle flange were installed.

The plumbing fixture 80 is further provided with drainage openings 28. The drainage openings 28 are in fluid communication with the flow passage 18 and are configured to permit liquid to enter the flow passage 18 through the drainage openings 28. Should there be a built-up of water moisture in a surface surrounding a waste plumbing installation, water can syphon through the surface and weep through the drainage openings 28 into the flow passage 18. Such water can then be drained via the waste plumbing installation.

The plumbing fixture 80 has an inlet conduit 14 of 100 mm. The outlet conduit 16 in turn is dimensioned to be received within a riser pipe having a diameter of either 40 mm or 50 mm.

Figure 11:
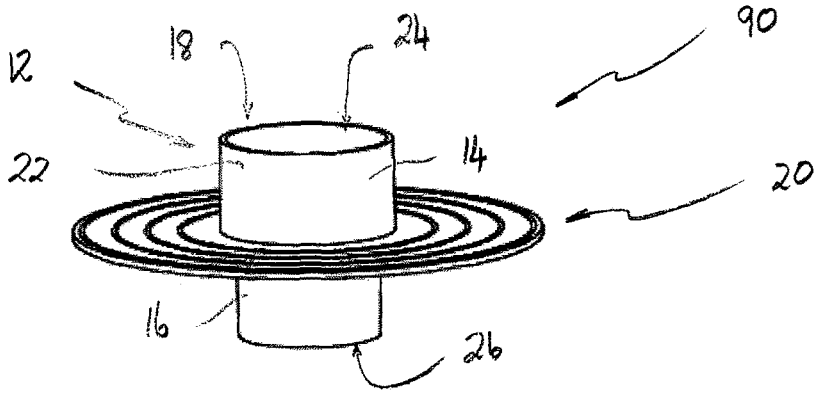
FIG. 11 is a schematic perspective view of a fifth embodiment plumbing fixture.
Figure 12:
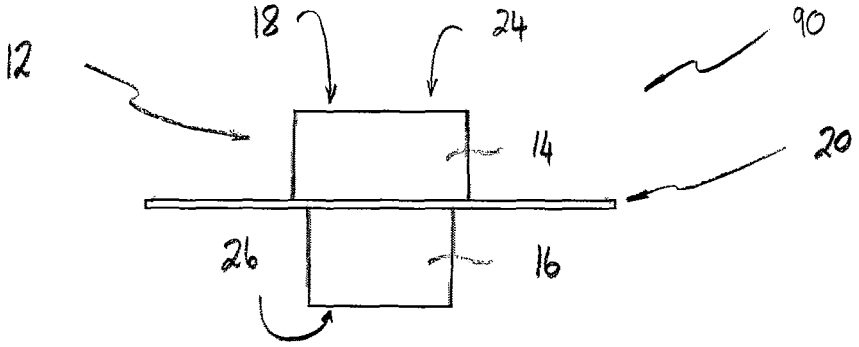
FIG. 12 is a schematic side view of the plumbing fixture of FIG. 11.

FIGS. 11 and 12 show a fifth embodiment plumbing fixture 90 for installation in a non-illustrated waste plumbing installation. The plumbing fixture 90 comprises a fixture body 12 having an inlet conduit 14 which defines an inlet opening 24 having an inlet diameter. The fixture body 12 includes an outlet conduit 16 which defines an outlet opening 26 with an outlet diameter. The inlet and outlet conduits 14, 16 define a flow passage 18 to provide fluid communication between the inlet and outlet openings 24, 26. The plumbing fixture 90 further includes a peripheral flange 20 which extends outwardly from an outer surface 22 of the fixture body 12 and is located at a position between the inlet and outlet opening 24, 26. The peripheral flange 20 is sized and operatively adapted to span a non-illustrated opening formed between the plumbing installation and a surface surrounding the plumbing installation so as to operate as if a conventional puddle flange were installed. The plumbing fixture 90 is sized for coupling with a pipe riser having a 50 mm diameter.

Figure 13:
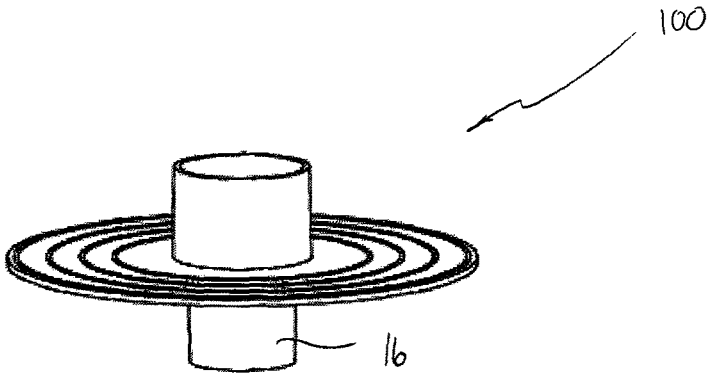
FIG. 13 is a schematic perspective view of a sixth embodiment plumbing fixture.
Figure 14:
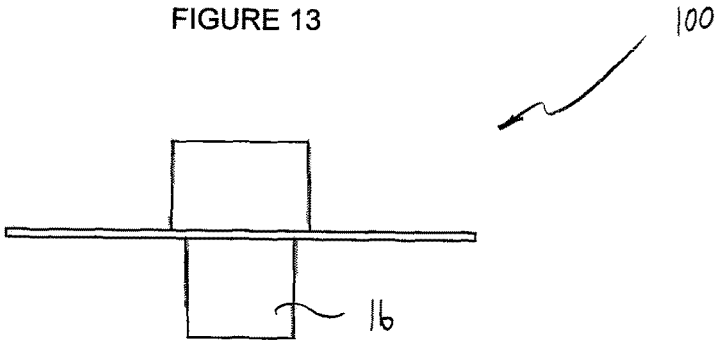
FIG. 14 is a schematic side view of the plumbing fixture of FIG. 13.

A sixth embodiment plumbing fixture 100 is shown in FIGS. 13 and 14. The plumbing fixture 100 operates in a manner similar to the plumbing fixture 90 of FIGS. 11 and 12. However, where the plumbing fixture 90 is adapted for coupling with a 50 mm riser pipe, the outlet conduit 16 of the plumbing fixture 100 is sized for coupling with a 40 mm riser pipe.

Figure 15:
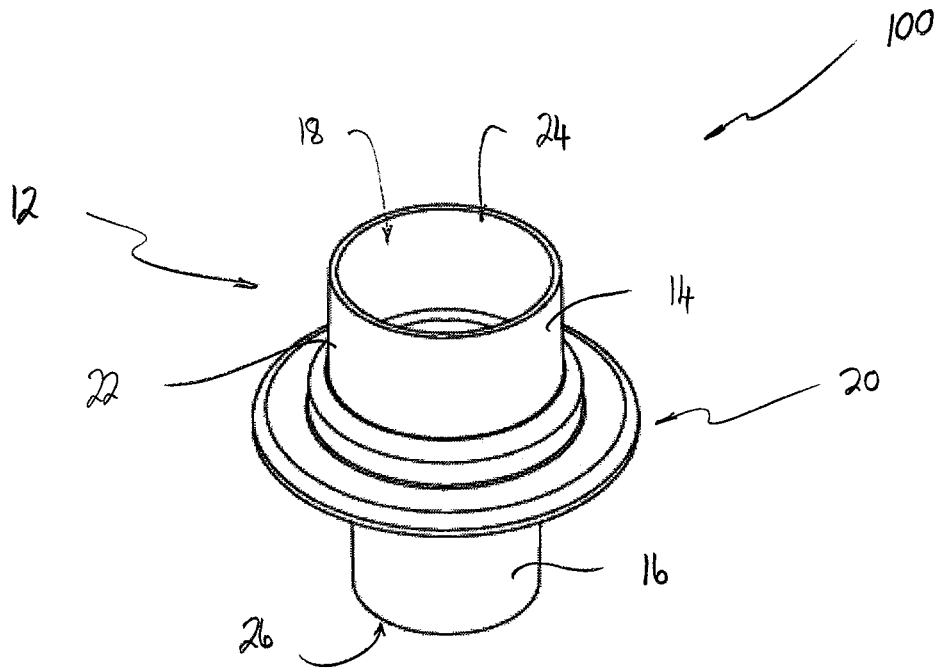
FIG. 15 is a schematic front perspective view of a seventh embodiment plumbing fixture.
Figure 16:
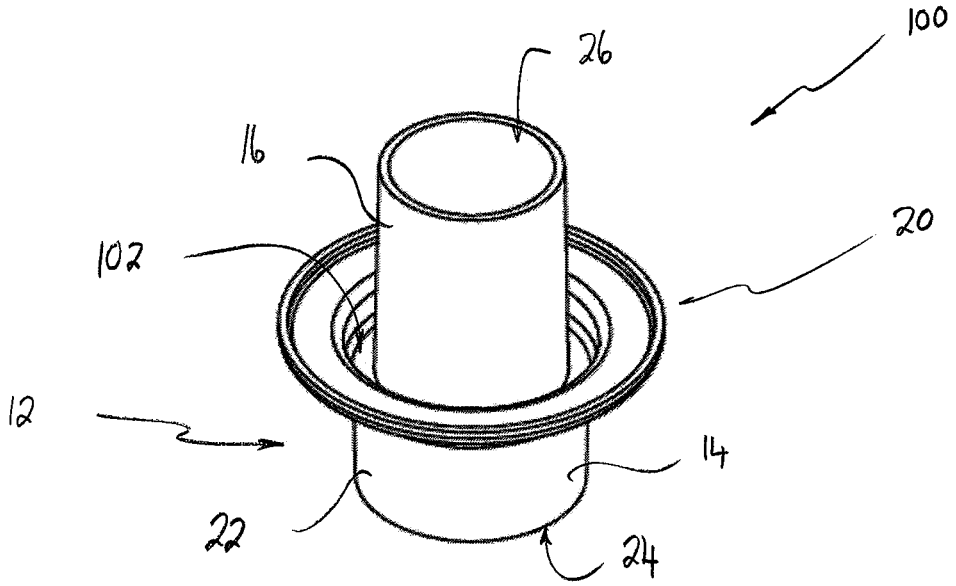
FIG. 16 is a schematic bottom perspective view of the plumbing fixture of FIG. 15.

FIGS. 15 and 16 show a seventh embodiment plumbing fixture 100 for installation in a non-illustrated waste plumbing installation. The plumbing fixture 100 comprises a fixture body 12 having an inlet conduit 14 which defines an inlet opening 24 having an inlet diameter. The fixture body 12 includes an outlet conduit 16 which defines an outlet opening 26 with an outlet diameter. The inlet and outlet conduits 14, 16 define a flow passage 18 to provide fluid communication between the inlet and outlet openings 24, 26. The plumbing fixture 100 further includes a peripheral flange 20 which extends outwardly from an outer surface 22 of the fixture body 12 and is located at a position between the inlet and outlet opening 24, 26. The peripheral flange 20 is sized and operatively adapted to span a non-illustrated opening formed between the plumbing installation and a surface surrounding the plumbing installation.

The peripheral flange 20 defines a recess 102. The recess 102 is adapted to receive an upper end portion of a non-illustrated 50 mm riser pipe. In particular, the peripheral flange 20 with its recess 102 facilitates coupling with a riser pipe which extends above a floor surface making it difficult to use the plumbing fixtures discussed in FIGS. 1 to 14 as well as conventional puddle flanges. By providing the recess 102 which is sized for receiving the upper edge of a non-illustrated riser pipe and a flange 20, which can span the gap arising from the cut-out in a surface surrounding the riser pipe, a sealed installation can be achieved. In particular, it is not necessary to cut the riser pipe flush with the floor surface to install the plumbing fixture 100, thus avoiding possible damage to the floor surface.

Figure 17:
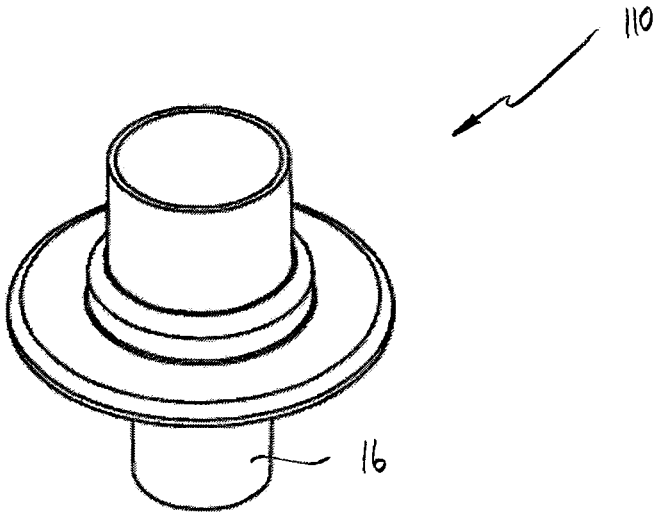
FIG. 17 is a schematic front perspective view of an eighth embodiment plumbing fixture.
Figure 18:
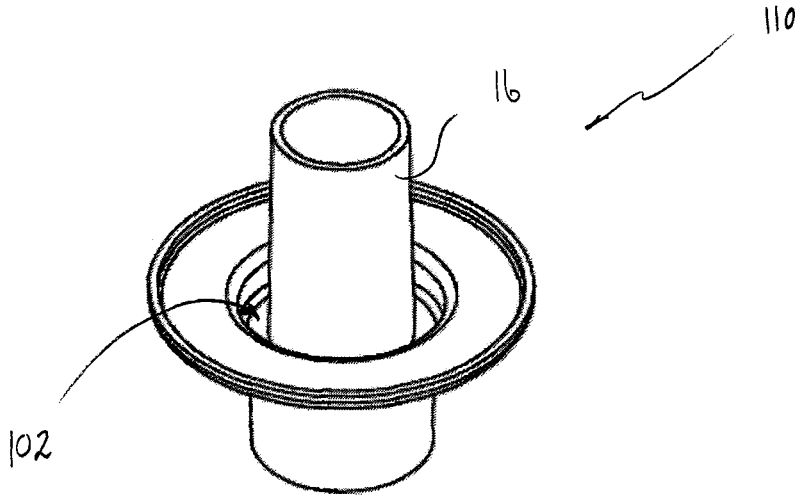
FIG. 18 is a schematic bottom perspective view of the plumbing fixture of FIG. 17.

An eighth embodiment plumbing fixture 110 is shown in FIGS. 17 and 18. The plumbing fixture 110 operates in a manner similar to the plumbing fixture 100 of FIGS. 15 and 16. However, where the plumbing fixture 100 is adapted for coupling with a 50 mm riser pipe, the outlet conduit 16 and recess 102 of the plumbing fixture 110 is sized for coupling with a 40 mm riser pipe.

The various above described embodiment plumbing fixtures have the desired feature of enabling slab repair, coupling with a waste riser pipe and the effects of a puddle cover plate all achieved with a single component which can be installed with relative ease.

Although not described above, it will be readily appreciated by a person skilled in the art that a suitable solvent cement or other suitable adhesive is to be employed to attach the various embodiment plumbing fixtures to pipes and/or other components of a plumbing installation.

Although the invention is described above in relation to preferred embodiments, it will be appreciated by those skilled in the art that it is not limited to those embodiments, but may be embodied in many other forms.

The invention claimed is:

1. A plumbing fixture to be installed in a waste plumbing installation, the plumbing fixture including:

a fixture body having an inlet conduit defining an inlet opening, and an outlet conduit defining an outlet opening, the inlet and outlet conduits defining a flow passage to provide fluid communication between the inlet opening and the outlet opening, the outlet conduit operatively placed in fluid communication with the waste plumbing installation; and a peripheral flange which extends outwardly from an outer surface of the fixture body and is located at a position between the inlet opening and the outlet opening of the fixture body, the peripheral flange operatively adapted to span an opening formed between the plumbing installation and a surface surrounding the plumbing installation;

wherein the inlet conduit includes an inlet conduit wall, the inlet conduit wall tapering outwardly in a direction extending from the peripheral flange to the inlet opening.

2. A plumbing fixture according to claim 1, including at least one drainage opening which extends through at least the inlet conduit or the outlet conduit to allow liquid to enter the flow passage through the at least one drainage opening.

3. A plumbing fixture according to claim 2, wherein the drainage opening extends through the peripheral flange.

4. A plumbing fixture according to claim 3, wherein a barrier is attached to the fixture body and is positioned to cover the at least one drainage opening.

5. A plumbing fixture according to claim 4, wherein the inlet opening is operatively adapted to permit waste liquid to enter the flow passage.

6. A plumbing fixture according to claim 5, wherein the outlet opening is operatively adapted to allow waste liquid to exit the flow passage.

7. A plumbing fixture according to claim 6, wherein the fixture body defines a barrier recess operatively adapted to hold a portion of the barrier.

8. A plumbing fixture according to claim 7, wherein the barrier recess is formed in an outer surface of the inlet conduit.

9. A plumbing fixture according to claim 8, wherein the at least one drainage opening is a first drainage opening and the flange includes a plurality of drainage openings.

10. A plumbing fixture according to claim 9, wherein the barrier comprises open cell foam.

11. A plumbing fixture according to claim 1, wherein the inlet opening is closed with a removable cap.

12. A plumbing fixture according to claim 1, wherein the inlet opening has an inlet diameter and the outlet opening has an outlet diameter, wherein the dimensions of the inlet diameter differ from the dimensions of the outlet diameter.

13. A plumbing fixture according to claim 12, wherein the dimensions of the inlet diameter are larger than the dimensions of the outlet diameter.

14. A plumbing fixture according to claim 1, wherein the outlet conduit includes an outlet conduit wall, the outlet conduit wall tapering outwardly in a direction extending from the peripheral flange to the outlet opening.

15. A waste plumbing installation comprising:

a plumbing fixture having a fixture body having an inlet conduit defining an inlet opening, and an outlet conduit defining an outlet opening, the inlet and outlet conduits defining a flow passage to provide fluid communication between the inlet opening and the outlet opening, the outlet conduit operatively placed in fluid communication with the waste plumbing installation; and a peripheral flange which extends outwardly from an outer surface of the fixture body and is located at a position between the inlet opening and the outlet opening of the fixture body, the peripheral flange operatively adapted to span an opening formed between the plumbing installation and a surface surrounding the plumbing installation;

wherein the outlet conduit includes an outlet conduit wall, the outlet conduit wall tapering outwardly in a direction extending from the peripheral flange to the outlet opening.

16. A waste plumbing installation as set forth in claim 15, wherein the plumbing fixture includes at least one drainage opening which extends through at least the inlet conduit or the outlet conduit to allow liquid to enter the flow passage through the at least one drainage opening.

17. A plumbing fixture according to claim 16, wherein the drainage opening extends through the peripheral flange.

18. A plumbing fixture according to claim 17, wherein a barrier is attached to the fixture body and is positioned to cover the at least one drainage opening.

19. A waste plumbing installation as set forth in claim 15, wherein the fixture body inlet opening is closed with a removable cap.

20. A waste plumbing installation as set forth in claim 15, wherein the fixture body inlet opening has an inlet diameter and the outlet opening has an outlet diameter, wherein the dimensions of the inlet diameter differ from the dimensions of the outlet diameter.

* * * * *